US011246440B2

(12) United States Patent
Kim et al.

(10) Patent No.: US 11,246,440 B2
(45) Date of Patent: Feb. 15, 2022

(54) CLOTHES HANGER

(71) Applicant: Dan Ha Kim, Seongnam-si (KR)

(72) Inventors: Dan Ha Kim, Seongnam-si (KR); Hyun joo Kim, Seongnam-si (KR); Doo Jin Kim, Seongnam-si (KR)

(73) Assignee: Dan Ha Kim, Seongnam-si (KR)

( * ) Notice: Subject to any disclaimer, the term of this patent is extended or adjusted under 35 U.S.C. 154(b) by 0 days.

(21) Appl. No.: 16/770,995

(22) PCT Filed: May 16, 2019

(86) PCT No.: PCT/KR2019/005867
§ 371 (c)(1),
(2) Date: Jun. 9, 2020

(87) PCT Pub. No.: WO2020/022623
PCT Pub. Date: Jan. 30, 2020

(65) Prior Publication Data

US 2021/0127877 A1 May 6, 2021

(30) Foreign Application Priority Data

Jul. 23, 2018 (KR) ..... 10-2018-0085194

(51) Int. Cl.
*A47G 25/40* (2006.01)
*A47G 25/20* (2006.01)

(52) U.S. Cl.
CPC ..... *A47G 25/4061* (2013.01); *A47G 25/20* (2013.01)

(58) Field of Classification Search
CPC ..... A47G 25/0461; A47G 25/4046; A47G 25/40; A47G 25/20; A47G 25/4038; A47G 25/4061; A47G 25/18; A47G 25/183; A47G 25/186; A47G 25/28; A47G 25/50
See application file for complete search history.

(56) References Cited

U.S. PATENT DOCUMENTS 589,901 A * 9/1897 Lincoln et al. .... A47G 25/4061 223/94
838,839 A * 12/1906 Bernard ..... A47G 25/4061 223/89
881,818 A * 3/1908 Morrison ..... A47G 25/4038 223/94
1,476,555 A * 12/1923 Timberlake ..... D06F 59/02 223/69
1,540,363 A * 6/1925 Reid ..... A47G 25/40 223/88

(Continued)

FOREIGN PATENT DOCUMENTS

JP 3031693 11/1996
JP 09-037923 2/1997

(Continued)

*Primary Examiner* — Ismael Izaguirre
(74) *Attorney, Agent, or Firm* — Lex IP Meister, PLLC

(57) ABSTRACT

A clothes hanger is proposed. The clothes hanger is configured to allow an upper garment of a piece of clothing to be quickly and neatly folded up/down and left/right and finished even using a simple clothes hanger structure, and allow a storage space such as a dresser to be used as efficiently as possible, by having a clothing body part holder detachably coupled to the clothes hanger holding the upper portion (shoulders and arms) of a piece of clothing to holder the lower portion of the clothing.

5 Claims, 8 Drawing Sheets

(56) References Cited

U.S. PATENT DOCUMENTS

| | | | | | |
|---|---|---|---|---|---|
| 1,545,765 | A * | 7/1925 | Harold | A47G 25/4061 | 223/94 |
| 1,743,234 | A * | 1/1930 | Porter | A47G 25/4061 | 223/94 |
| 2,777,619 | A * | 1/1957 | Cook, Sr. | A47G 25/40 | 223/90 |
| 3,219,241 | A * | 11/1965 | Newton | A47G 25/4061 | 223/94 |
| 3,737,079 | A * | 6/1973 | Bliss | A47G 25/20 | 223/68 |
| 6,328,186 | B1 * | 12/2001 | Wing | A47G 25/20 | 223/89 |
| 2009/0120974 | A1 * | 5/2009 | Rossaki | A47G 25/20 | 223/94 |
| 2016/0022076 | A1 * | 1/2016 | Yip | A47G 25/50 | 223/94 |
| 2018/0338630 | A1 * | 11/2018 | Jianping | A47G 25/20 | |
| 2020/0100612 | A1 * | 4/2020 | Karelis | A47G 25/32 | |

FOREIGN PATENT DOCUMENTS

| | | | | |
|---|---|---|---|---|
| JP | 10-057206 | | 3/1998 | |
| JP | 2004-344445 | | 12/2004 | |
| JP | 5774167 | | 9/2015 | |
| WO | WO-2010050661 | A * | 5/2010 | A47H 7/02 |

* cited by examiner

CLOTHES HANGER

TECHNICAL FIELD

The present invention relates to a clothes hanger and, more particularly, to a clothes hanger enabling an upper garment to be quickly and neatly folded up/down and left/right and finished even using a simple clothes hanger structure, and enabling a storage space such as a dresser to be used as efficiently as possible, by having a clothing body part holder detachably coupled to the clothes hanger holding the upper portion (shoulders and arms) of a piece of clothing to hold the lower portion of the clothing.

BACKGROUND ART

In general, clothing and clothes are divided into an upper garment and a lower garment, and the upper garment has a body part and arm parts, so it was very difficult and inconvenient to fold and store the upper garment without a wrinkle.

People usually arrange and keep upper garments such as a dress shirt by hanging them on specific clothes hangers and then hanging the clothes hangers on a rod or rings in a dresser after washing the upper garments to minimize wrinkles at their home. In this case, the space for keeping upper garments relatively increases, so it is difficult to efficiently use the space.

Accordingly, people usually fold upper garments of clothing in a rectangular shape and stack them in a dresser. In particular, when preparing clothes for a long-period stay such as a travel or an official trip, people usually fold and keep the clothes in suitcases.

When an upper garment is folded for keeping, the work itself of folding the upper garment is relatively difficult and takes a long time.

This problem frequently occurs not only homes, but also in clothes shops in the process of hanging upper garments on a rod or rings in a dresser to display or keep them.

DISCLOSURE

Technical Problem

The present invention has been made in an effort to solve the problems and an objective of the present invention is to provide a clothes hanger enabling an upper garment to be quickly and neatly folded up/down and left/right and finished even using a simple clothes hanger structure, and enabling a storage space to be used as efficiently as possible, by having a clothing body part holder detachably coupled to the clothes hanger holding the upper portion (shoulders and arms) of a piece of clothing to hold the lower portion of the clothing (upper garment).

Another objective of the present invention is to provide a clothes hanger manufactured such that a hook can horizontally rotate (360 degrees) about a shoulder holder so that the front-rear length of a piece of clothing held on the clothes hanger can be adjusted, thereby being able to increase convenience when arranging and finishing a piece of clothing.

Another objective of the present invention is to provide a clothes hanger enabling a user to easily fold and finish a piece of clothing by simply manually lifting the lower portion of the body part of the clothing because a clothing body part holder holding the lower portion of a piece of clothing has a rotatable U-shaped fitting groove and a fastening part that can be fastened to a neck of the hanger.

Technical Solution

In order to achieve the objectives of the present invention, a clothes hanger enabling a piece of clothing to be arranged and finished includes: a hook having a hanging groove; a pair of shoulder holders extending downward and left and right from the hook to hold shoulders of a piece of clothing; a pair of arm holders connected to ends of the pair of shoulder holders to horizontally rotate; and a clothing body part holder having a fitting groove part at a side that is horizontally fitted on a lower portion of a piece of clothing to hold the lower portion, and a fastening part at another side that is fastened to the hook.

The hook may have the hanging groove formed at an upper portion and a neck formed at a lower portion and being able to horizontally rotate with respect to the pair of shoulder holders, and the fastening part of the clothing body part holder may have an end detachably coupled to the neck and another end rotatably coupled to the fitting groove part.

The fitting groove part of the clothing body part holder may have a U-shape and is horizontally fitted at a predetermined position on a lower portion of a body part of a piece of clothing.

The neck may have an L-shaped coupling protrusion and a coupling hole corresponding to the coupling protrusion is formed at the fastening part to the detachably coupled.

The pair of arm holders may be connected to ends of the pair of shoulder holders to horizontally rotate inward and outward.

When the pair of arm holders rotates inward and outward, the pair of arm holders may be rotated at an angle downward with respect to the shoulder holders.

The pair of arm holders may be rotated 180 degrees inward toward each other when a piece of clothing is arranged and finished such that not only arms of the clothing, but left and right portions of a body part of the clothing are respectively folded toward each other; the entire clothing body part holder may be lifted up with the U-shaped fitting groove part horizontally fitted at a predetermined position on a lower portion of the body part of the clothing while the clothing body part holder is turned over such that the coupling hole of the fastening part corresponds to the coupling protrusion of the neck; and then the U-shaped fitting groove part may be rotated inward with respect to the fastening part with the coupling hole of the fastening part and the coupling protrusion of the neck coupled to each other such that the entire lower end portion of the clothing exposed to the outside through the U-shaped fitting groove part is folded inward not to be shown, thereby completing arranging and finishing arms and a body part of the clothing.

Advantageous Effects

As described above, according to the clothes hanger of the present invention, since the clothing body part holder is detachably coupled to the clothes hanger holding the upper portion (shoulders and arms) of a piece of clothing, it is possible to quickly and neatly fold up/down and left/right and finish an upper garment even using a simple clothes hanger structure, and to use a storage space such as a dresser as efficiently as possible.

Further, the hook is formed to be able to horizontally rotate (360 degrees) with respect to the shoulder holders, so a piece of clothing hung on the clothes holder can be moved forward and rearward, and accordingly, there is another advantage that it is possible to more conveniently arrange and finish a piece of clothing.

Further, since the clothing body part holder that holds the lower portion of a piece of clothing has the rotatable U-shaped fitting groove part and the fastening part that can be fastened to the neck of the clothes hanger, it is possible to simply manually arrange and finish a piece of clothing by easily lifting the lower portion of the body part of the clothing.

BEST MODE

The present invention may be accomplished in various ways without departing from the spirit and the main features of the present invention. Accordingly, embodiments of the present invention are only examples and should not be construed as being limitative in all terms.

Terms used in the specification, such as "first", "second", etc., may be used to describe various components, but the components are not to be construed as being limited to the terms.

The terms are used only to distinguish one component from another component. For example, the 'first' component may be named the 'second' component, and vice versa, without departing from the scope of the present invention.

It is to be understood that when one element is referred to as being "connected to" or "coupled to" another element, it may be connected directly to or coupled directly to another element or be connected to or coupled to another element, having the other element intervening therebetween.

On the other hand, it is to be understood that when one element is referred to as being "connected directly to" or "coupled directly to" another element, it may be connected to or coupled to another element without the other element intervening therebetween.

Terms used in the present specification are used only in order to describe specific exemplary embodiments rather than limiting the present invention. Singular forms are intended to include plural forms unless the context clearly indicates otherwise.

It will be further understood that the terms "comprises" or "have" used in this specification, specify the presence of stated features, steps, operations, components, parts, or a combination thereof, but do not preclude the presence or addition of one or more other features, numerals, steps, operations, components, parts, or a combination thereof.

Unless defined otherwise, it is to be understood that all the terms used in the specification including technical and scientific terms has the same meaning as those that are understood by those who skilled in the art.

It will be further understood that terms defined in dictionaries that are commonly used should be interpreted as having meanings that are consistent with their meanings in the context of the relevant art and will not be interpreted in an idealized or overly formal sense unless expressly so defined herein.

Exemplary embodiments of the present invention will be described in detail hereafter with reference to the accompanying drawings in order for those skilled in the art to be able to easily accomplish the present invention.

Figure 1:
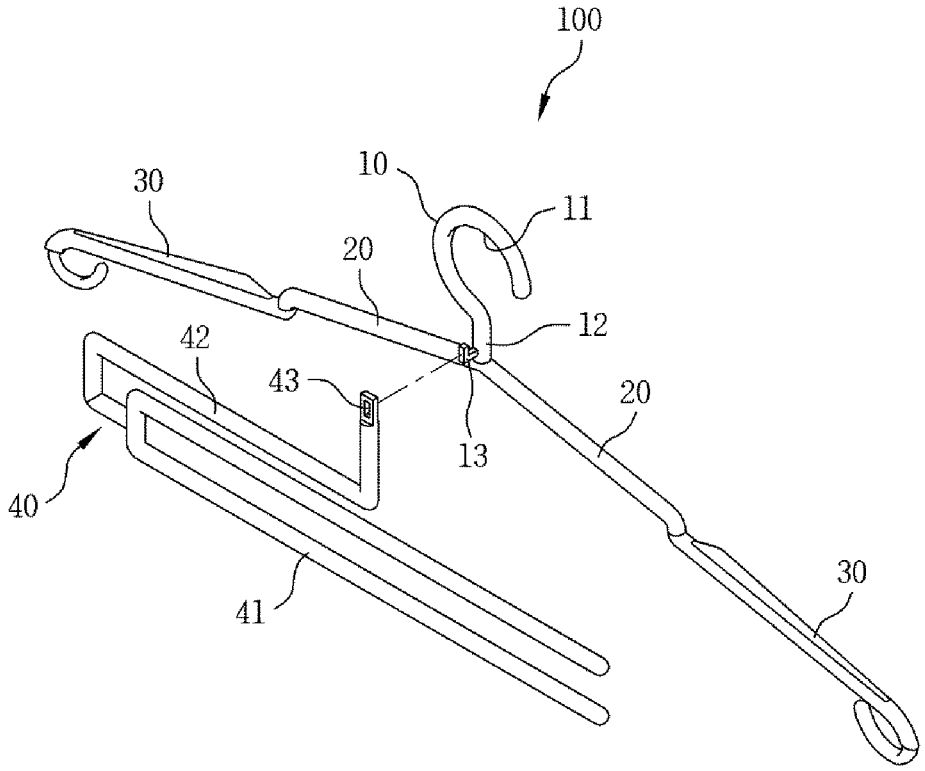
FIG. 1 is a perspective view showing a clothes hanger according to an embodiment of the present invention.
Figure 2:
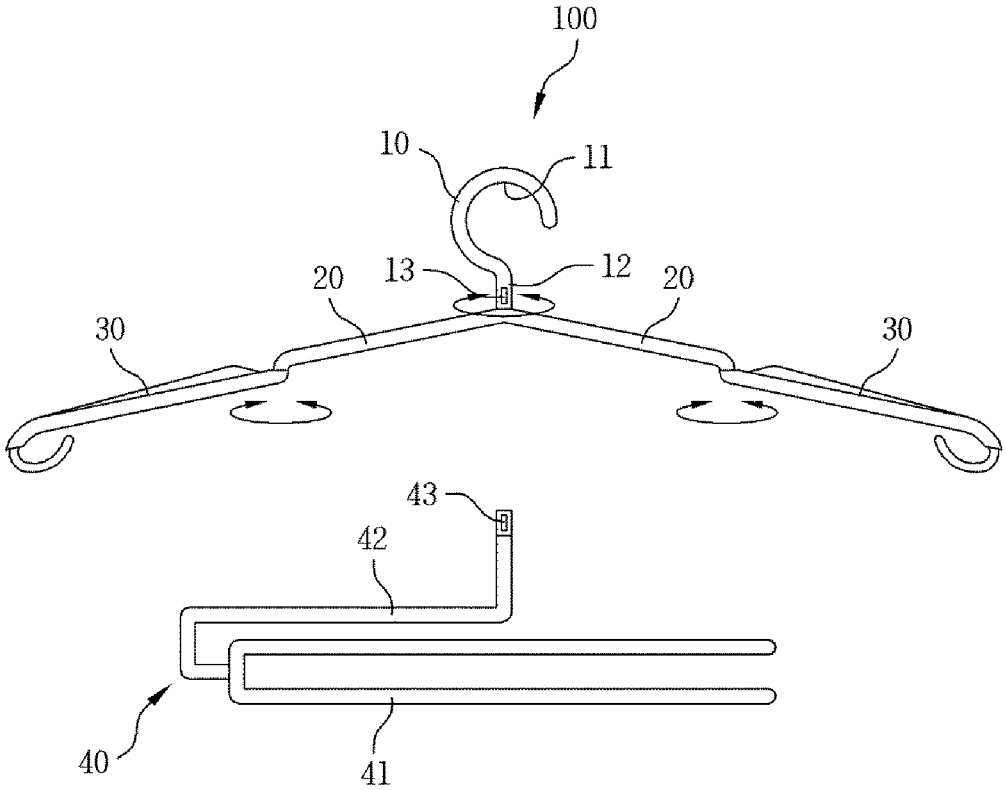
FIG. 2 is a perspective view showing the clothes hanger according to an embodiment of the present invention before it is assembled.
Figure 3:
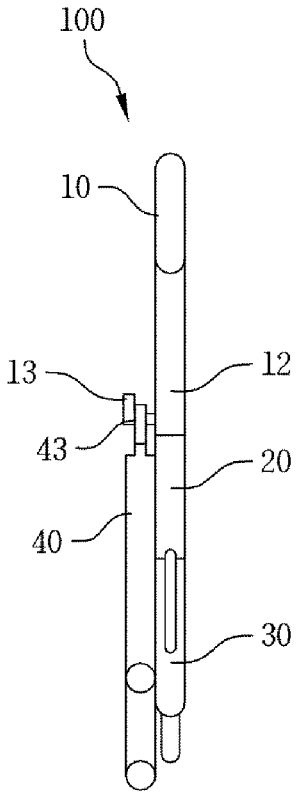
FIG. 3 is a side view showing an assembly of the clothes hanger according to an embodiment of the present invention.

FIG. 1 is a perspective view showing a clothes hanger according to an embodiment of the present invention, FIG. 2 is a perspective view showing the clothes hanger according to an embodiment of the present invention before it is assembled, and FIG. 3 is a side view showing an assembly of the clothes hanger according to an embodiment of the present invention.

As shown in the figures, a clothes hanger 100 that can arrange and finish a piece of clothing according to an embodiment of the present invention largely has a hook 10, a pair of shoulder holders 20, a pair of arm holders 30, and a clothing body part holder 40.

That is, the clothes hanger 100 according to an embodiment of the present invention has: a hook 100 having a hanging groove 11 at the upper portion and a neck 12 at the lower portion; a pair of shoulder holders 20 extending downward and left and right from the hook 10 to hold the shoulders of a piece of clothing; a pair of arm holders 30 rotatably connected to ends of the pair of shoulder holders; and a clothing body part holder 40 having a fitting groove part 41 at a side that is horizontally fitted on a lower portion of a piece of clothing to hold the lower portion, and a fastening part 42 at another side that is fastened to the neck 12.

The terms "left", "right", "upper", "lower", "horizontal", "front-rear", etc. are used to discriminate and indicate relative positions or directions without meaning absolute positions or direction.

Further, the clothing described herein may be an upper garment such as a dress shirt, but the kinds of clothing is not limited.

The hook 10 is provided to hang the clothes hanger 100 of the present invention on a rod, a ring, or the like in a dresser and has the hanging groove 11 formed in a claw shape at the upper portion that can be hung on a rod, a ring, or the like in a dresser, and the neck 12 at the lower portion that can be rotatably integrally connected to the pair of shoulder holders 20.

The neck 12 is formed to be able to horizontally rotate (360 degrees) with respect to the shoulder holders 20, so the piece of clothing hung on the clothes hanger 100 can be moved forward and rearward, thereby making it more convenient to arrange and finish the clothing.

Further, the neck 12 has a substantially L-shaped coupling protrusion 13 that protrudes forward, so the neck 12 can be easily detachably coupled to a coupling hole 43 formed at the fastening part 42 to be described below (FIG. 3).

The shoulder holders 20, as shown in FIGS. 1 and 2, are connected to the left and right sides of the neck 12 formed at the lower portion of the hook 10 when seen from the front, so they hold the shoulders of a piece of clothing when the clothing is hung on the clothes hanger.

That is, the shoulder holders 20 are a left shoulder holder and a right shoulder holder, which respectively hold the left shoulder and the right shoulder of a piece of clothing.

The arm holders 30 are left and right arm holders, are respectively connected to the ends of the shoulder holders to be able to rotate horizontally (180 degrees) inward/outward, that is, left/right, and respectively hold the left and right arms of a piece of clothing. Further, the arm holders 30 are rotated inward (180 degrees) so that the held left and right arms of a piece of clothing (actually including portions of the left and right portion of the body part of the piece of clothing) can be folded inward to overlap each other with a vertical center line therebetween when the clothing is arranged and finished.

When the arm holders 30, that is, the left and right arm holders are rotated inward, they may be rotated at an angle slightly downward from the left and right shoulder holders so that the left and right arms of a piece of clothing can be naturally folded with the neck 12 at the lower portion of the hook 10 therebetween. That is, since the left and right arm holders and the left and right shoulder holders are inclined downward outward along shoulder lines, when the arm holders 30 are rotated inward with respect to the shoulder holders 20, the arm holders 30 are rotated at angle slightly downward in consideration of the inclined angles of the left and right shoulder holders, so the left and right arms of a piece of clothing and left and right portions of the body part of the clothing are naturally formed along accurate vertical straight lines when the clothing is folded, whereby the clothing is neatly folded and finished along vertical lines.

The clothing body part holder 40, as shown in FIGS. 1 and 2, has the U-shaped fitting groove part 41 in which the body part (lower portion) of a piece of clothing is horizontally fitted and held, and the fastening part 42 that is fastened to the neck 42, the lower portion of a piece of clothing can be folded upward and arranged and finished with the left and right arms, as described above.

The fitting groove part 41 of the clothing body part holder 40 has a U-shape so that the lower portion of the body part of a piece of clothing can be naturally horizontally fitted therein.

Further, the fastening part 42 of the clothing body part holder 40 has a coupling hole 43 at an end to correspond to the L-shaped coupling protrusion 13 of the neck 12 so that the fastening part 42 can be fastened, as shown in FIG. 3, with the entire clothing body part holder 40 lifted toward the neck 12. Further, another end of the fastening part 42 is coupled to the U-shaped fitting groove part 41 to be rotatable up and down such that the lower horizontal line of the body part of a piece of clothing fitted in the U-shaped fitting groove part 41 can be rotated up and down. Accordingly, the lower portion of the body part of a piece of clothing can be easily folded and finished.

FIGS. 4*a* to 4*e* are views sequentially showing a process of arranging and finishing arms and a body part of a piece of clothing using the clothes hanger according to an embodiment of the present invention, and a process of arranging and finishing arms and a body part of a piece of clothing using the clothes hanger according to an embodiment of the present invention is described in detail with reference to the figures.

Figure 4A:
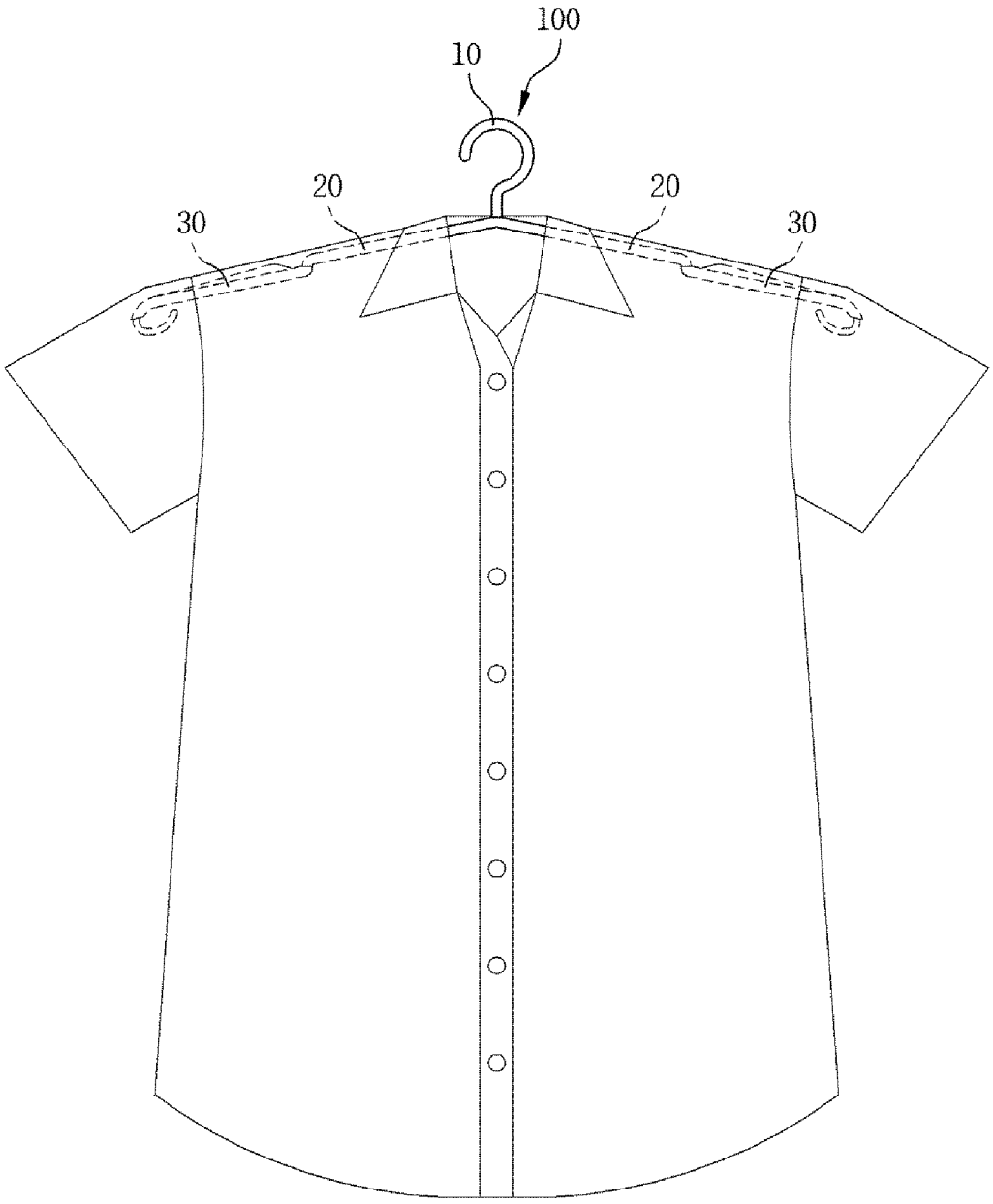
FIGS. 4*a* to 4*e* are views sequentially showing a process of arranging and finishing arm parts and a body parts of a piece of clothing using the clothes hanger according to an embodiment of the present invention.

First, as shown in FIG. 4*a*, an unfolded lower garment is hung on the clothes hanger having only the hook 10, the pair of shoulder holders 20, and the pair of arm holders 30 without the clothing body part holder 40 for holding the lower portion of the body part of a piece of clothing fastened.

Figure 4B:
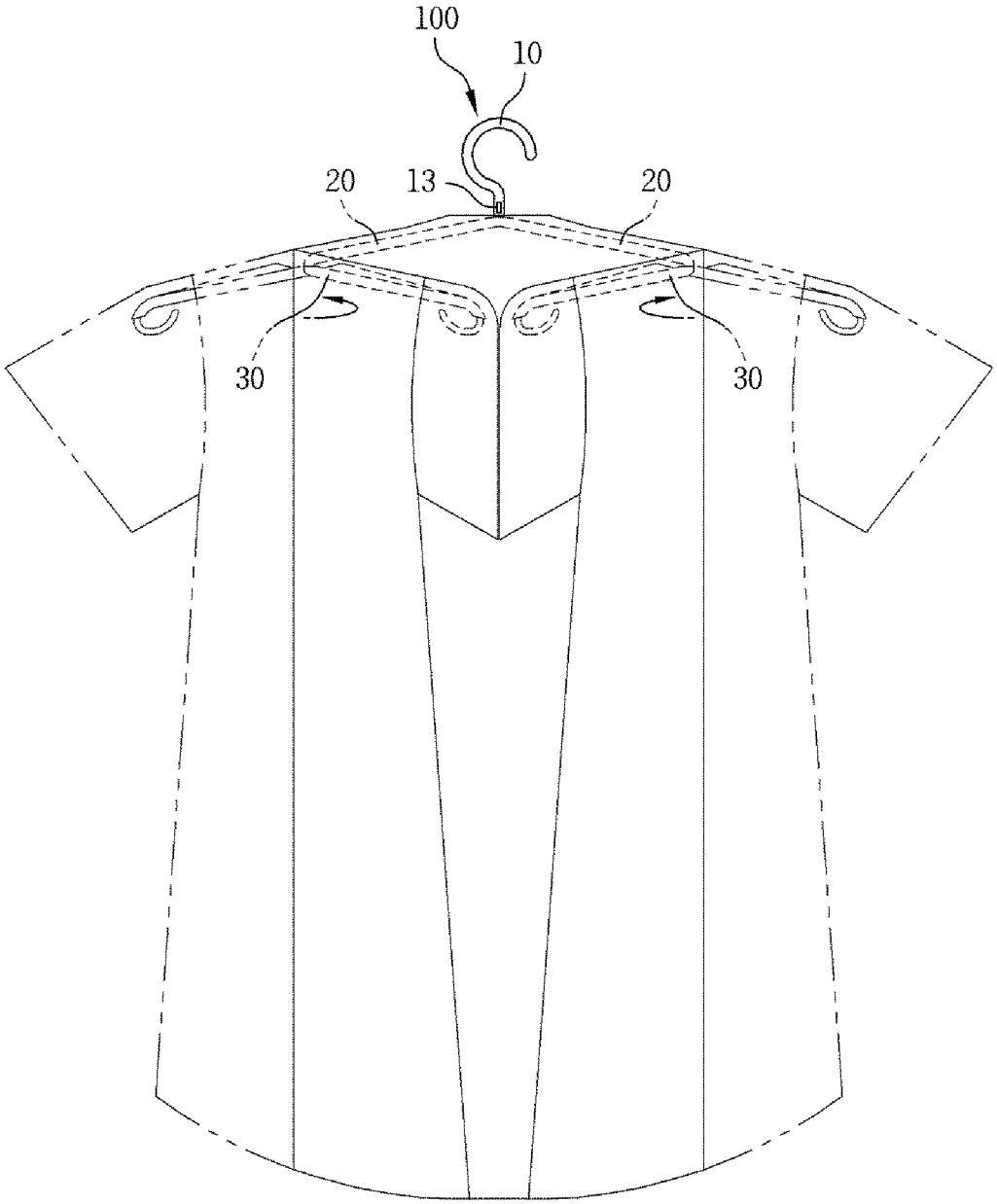

Next, as shown in FIG. 4*b*, the pair of arm holders 30, that is, the left and right arm holders are rotated 180 degrees inward so that not only the left and right arms of the clothing, but also left and right portions of the body part of the clothing are folded inward.

Figure 4C:
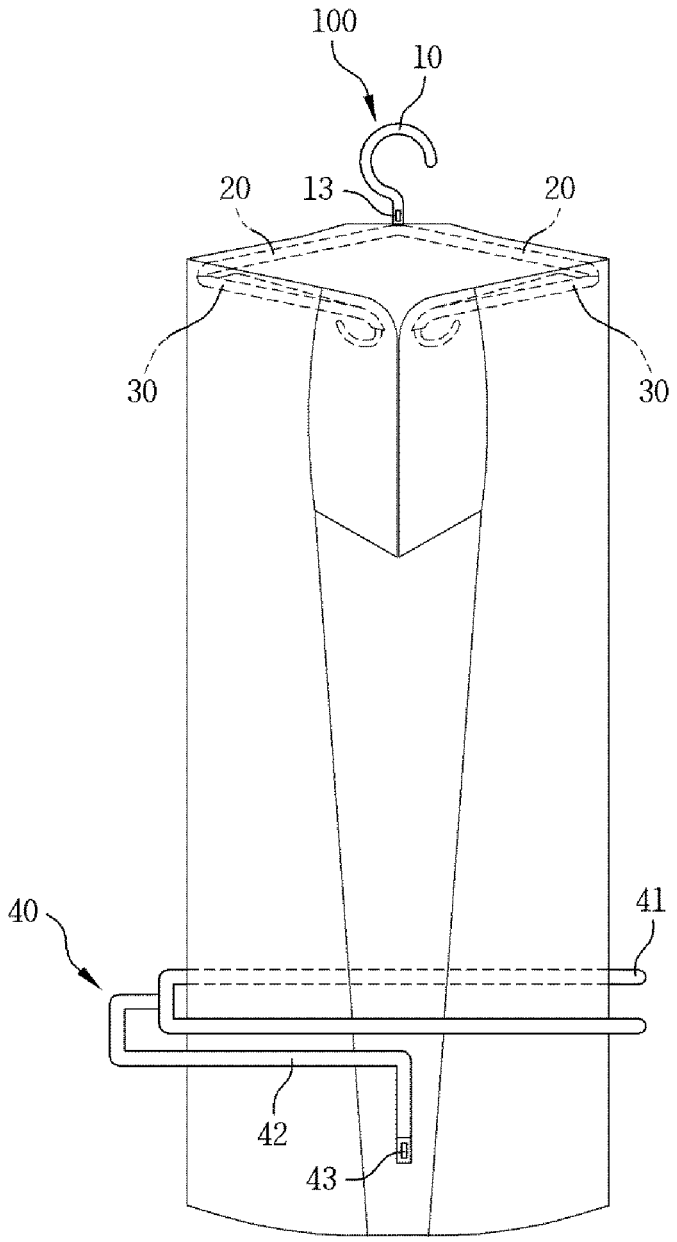

Next, as shown in FIG. 4*c*, the U-shaped fitting groove part 41 of the separated clothing body part holder 40 is horizontally fitted at a predetermined position on the lower portion of the body part of the clothing.

In this state, the fastening part 42 having the coupling hole 43 and the U-shaped fitting groove part 42 of the entire clothing body part holder 40 remain horizontal.

Figure 4D:
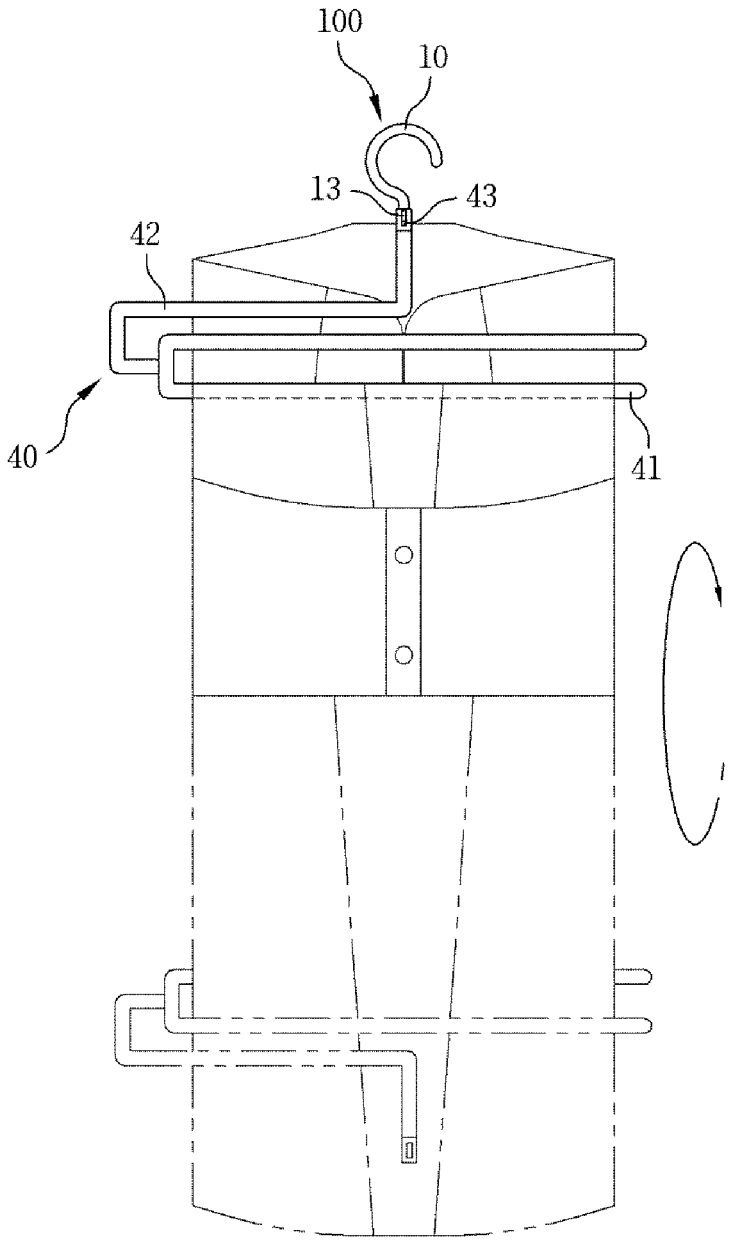

Next, as shown in FIG. 4*d*, a worker lifts up the entire clothing body part holder 40 with the U-shaped fitting groove part 41 horizontally fitted at a predetermined position on the lower portion of the body part of the clothing while turning over the clothing body part holder 40 such that the fastening part 42 faces up, and then fastens the coupling hole 43 of fastening part 42 and the L-shaped coupling protrusion 13 to each other.

Figure 4E:
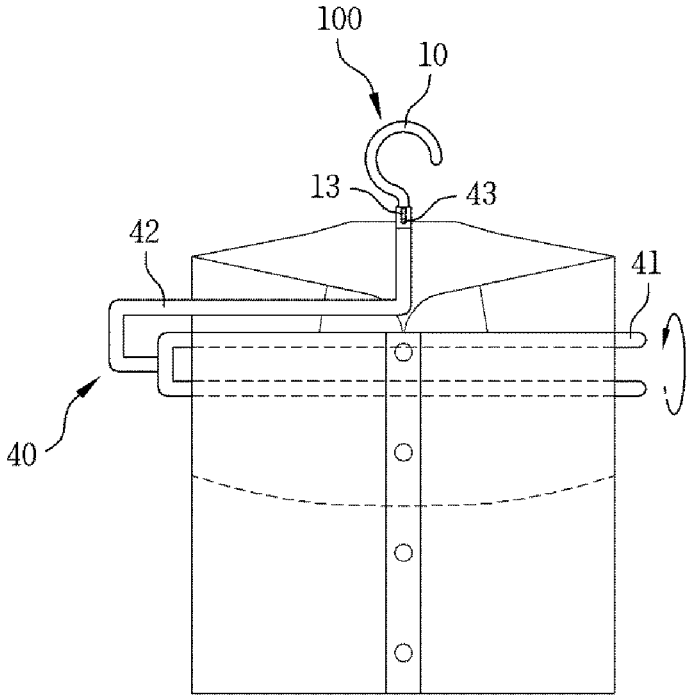

Next, as shown in FIG. 4*e*, the worker rotates the U-shaped fitting groove part 41 such that the U-shaped fitting groove part 41 is parallel with the fastening part 42 and the entire lower end portion of the body part of the clothing that is exposed to the outside through the U-shaped fitting groove part 41 is folded inward not to be shown, thereby completing arranging and finishing the clothing.

Accordingly, it is possible to stably keep pieces of clothing (upper garments) while securing a storage space by neatly arranging and finishing the clothing with the lower potions of the body parts and the arms folded and by hanging the hooks 10 on a rod, using the clothe hangers according to the present invention.

The embodiment of the present invention described above is only an example and it would be apparent to those skilled in the art that various modified and equivalent embodiments are possible.

Accordingly, those skilled in the art could understand that the present invention is not limited only to the specification described above.

Therefore, the technical protective region of the present invention should be determined by the scope described in claims. Further, it should be understood that the present invention includes the spirit of the present invention defined by claims and all modifications, equivalents, and replacements within the spirit.

INDUSTRIAL APPLICABILITY

The present invention enables an upper garment of a piece of clothing to be quickly and neatly folded up/down and left/right and finished even using a simple clothes hanger structure, and enabling a storage space such as a dresser to be used as efficiently as possible, by having a clothing body part holder detachably coupled to the clothes hanger holding the upper portion (shoulders and arms) of a piece of clothing to holder the lower portion of the clothing. Accordingly, the present invention can be usefully used for clothes hangers.

The invention claimed is:

1. A clothes hanger comprising:

a hook having a hanging groove;

a pair of shoulder holders extending downward and left and right from the hook to hold shoulders of a piece of clothing;

a pair of arm holders connected to ends of the pair of shoulder holders to horizontally rotate; and a clothing body part holder consisting of a fitting groove part that is a single U-shape bar, and a fastening part that is detachably coupled to the hook, wherein a total length of the fastening part is shorter than a total length of the fitting groove part, wherein the hook has the hanging groove formed at an upper portion and a neck formed at a lower portion and being able to horizontally rotate with respect to the pair of shoulder holders, wherein the fastening part of the clothing body part holder has a first end detachably coupled to the neck and a second end connected to the fitting groove part, wherein the fitting groove part of the clothing body part holder is configured to be horizontally fitted at a predetermined position on a lower portion of the piece of clothing such that the lower portion of the piece of clothing is positioned upward when the clothing body part holder is coupled to the hook with the fastening part.

2. The clothes hanger of claim 1, wherein the hook has the hanging groove formed at an upper portion and a neck formed at a lower portion and being able to horizontally rotate with respect to the pair of shoulder holders, and the fastening part of the clothing body part holder has an end detachably coupled to the neck and another end rotatably coupled to the fitting groove part.

3. The clothes hanger of claim 1, wherein the neck has an L-shaped coupling protrusion and a coupling hole corresponding to the coupling protrusion is formed at the fastening part to the detachably coupled.

4. The clothes hanger of claim 1, wherein the pair of arm holders is connected to ends of the pair of shoulder holders to horizontally rotate inward and outward.

5. The clothes hanger of claim 4, wherein when the pair of arm holders rotates inward and outward, the pair of arm holders is rotated at an angle downward with respect to the shoulder holders.

* * * * *